United States Patent [19]

Dehn

[11] 4,320,274

[45] Mar. 16, 1982

[54] COOKING UTENSIL FOR UNIFORM HEATING IN MICROWAVE OVEN

[75] Inventor: Rudolph A. Dehn, Schenectady, N.Y.

[73] Assignee: RTE Corporation, Waukesha, Wis.

[21] Appl. No.: 111,550

[22] Filed: Jan. 14, 1980

[51] Int. Cl.[3] ..... H05B 6/64

[52] U.S. Cl. ..... 219/10.55 E; 219/10.55 F; 99/451; 99/DIG. 14; 426/243

[58] Field of Search ..... 219/10.55 E, 10.55 F, 219/10.55 R, 10.55 M; 99/451, DIG. 14; 426/243, 234, 107; 126/390

[56] References Cited

U.S. PATENT DOCUMENTS

| | | | |
|---|---|---|---|
| 3,271,552 | 9/1966 | Krajewski | 219/10.55 E |
| 3,490,580 | 1/1970 | Brumfield et al. | 219/10.55 E |
| 3,835,280 | 9/1974 | Gades et al. | 219/10.55 E |
| 3,941,968 | 3/1976 | MacMaster et al. | 219/10.55 E |
| 3,965,323 | 6/1976 | Forker, Jr. et al. | 219/10.55 E |
| 4,006,338 | 2/1977 | Dehn | 219/10.55 F |

FOREIGN PATENT DOCUMENTS

| | | | |
|---|---|---|---|
| 52-9134 | 1/1977 | Japan | 219/10.55 F |
| 52-9135 | 1/1977 | Japan | 219/10.55 F |

OTHER PUBLICATIONS

"Packaging of Food for Microwave Food Service Applications", R. V. Decareau, Microwave Energy Applications Newsletter, vol. 12, No. 5, 1979, Published by International Microwave Power Institutes, p. 10.

*Primary Examiner*—B. A. Reynolds
*Assistant Examiner*—Philip H. Leung
*Attorney, Agent, or Firm*—Ronald E. Barry

[57] ABSTRACT

A continuous conductor pattern applied to a dielectric cooking utensil improves the distribution of microwave energy to the bottom surface of food being cooked. The energy is coupled from the electromagnetic field within the oven cavity by metal strip pickup probes on the hand grips or side walls which are part of the embedded metal layer. The conductor pattern on the bottom wall couples energy from the pickup probes to the central region of the utensil.

7 Claims, 5 Drawing Figures

COOKING UTENSIL FOR UNIFORM HEATING IN MICROWAVE OVEN

BACKGROUND OF THE INVENTION

This invention relates to microwave oven cookware and more particularly to utensils which aid in distributing the microwave energy more uniformly throughout the food being cooked.

Microwave ovens are designed to heat a large variety of loads having a range of material properties, sizes, and shapes. In order to achieve relatively uniform heating, the various microwave coupling elements are proportioned for best average heating. In addition, a rotary vane stirrer assembly is employed to vary the intensity, spatial distribution, and frequency of the microwave energy. Uneven heating persists in spite of these features and the recipe instructions generally require the user to manipulate the food by turning or inversion at specified times during the cooking cycle. Finally, the instructions may specify a holding period after the microwave energy source is shut off. During this time the heat within the food will diffuse to produce a more nearly isothermal product.

SUMMARY OF THE INVENTION

Dielectric cooking utensils have metal layer conductor patterns applied to distribute the microwave energy over the surface of the vessel or dish, and to couple the energy to the central region of the utensil and thus reduce variations in heat input to the food load being cooked. The patterned metal layer is continuous and includes one or more pickup probes and a bottom wall conductor pattern. The energy is coupled from the electromagnetic fields within the oven cavity by means of the pickup probes which are embedded in or on the handle grips, side walls, or other outer region of the utensil. The bottom wall conductor pattern couples the energy to the central region of the utensil to realize more uniform heating of the food.

One embodiment is a meat dish having metal strip pickup probes embedded in the hand grips on either side and a meandering conductor pattern to couple energy to the central region of the dish. A second embodiment is a cake pan having T-end metal strip pickup probes within the side wall and a bottom wall conductor pattern with a disk at the center of the pan. The conductor pattern is different for different general classes of foods and is shaped to optimize heat uniformity for that utensil.

DESCRIPTION OF THE PREFERRED EMBODIMENTS

Figure 1:
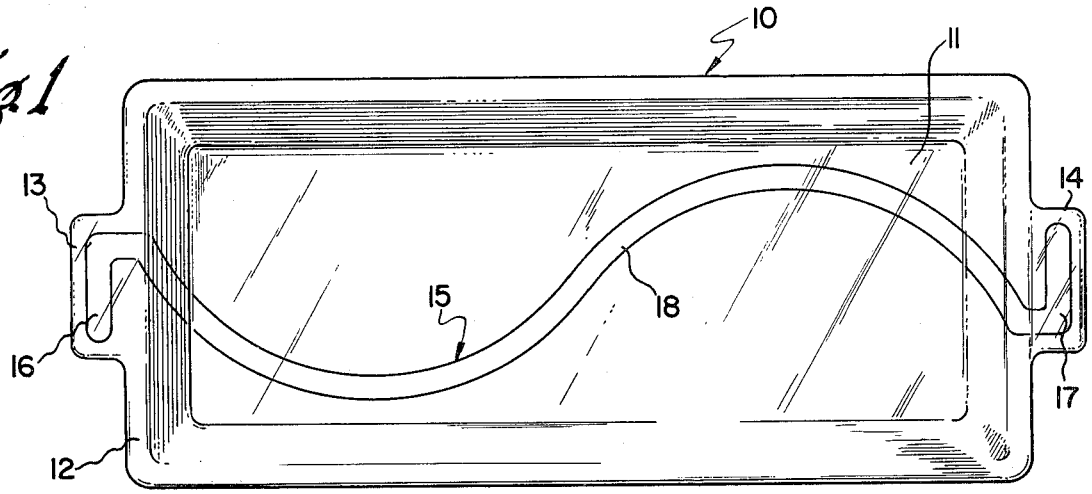
FIGS. 1 and 2 are top and side views of a rectangular meat dish with an embedded conductor pattern.
Figure 2:
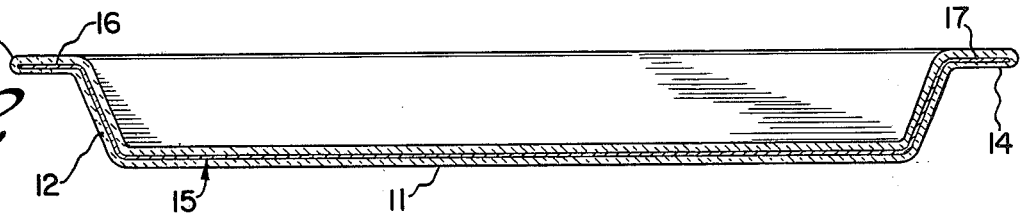

The rectangular dielectric dish in FIGS. 1 and 2 is used to cook roasts and other meats in a microwave oven. It is common for these high loss materials to overcook near the corners of such a dish (without a conductor pattern) while the center remains cooler. It is proposed to provide dielectric microwave cookware which have patterned metal layers applied to distribute the microwave energy over the surface of the utensil. The metal layer is fashioned to pick up energy from the electromagnetic fields within the oven cavity and bring it into the central region of the cookware underneath the food.

Utensil 10 is made of a dielectric material with low microwave energy absorption and has a bottom wall 11, a raised edge 12, and two laterally projecting hand grips 13 and 14. The patterned metal layer indicated generally at 15 is continuous and is embedded within the utensil. The monopole metal strip pickup probes 16 and 17 in the hand grips serve to couple microwave energy from the electromagnetic fields within the oven cavity to a meandering conductor pattern 18 in the bottom wall of the utensil. The patch of the metal pattern may be varied to concentrate the energy as desired. Energy is thus coupled to the central region of the cookware, underneath the food load, and thus reduces the variation in heat input to the food being cooked.

Figure 3:
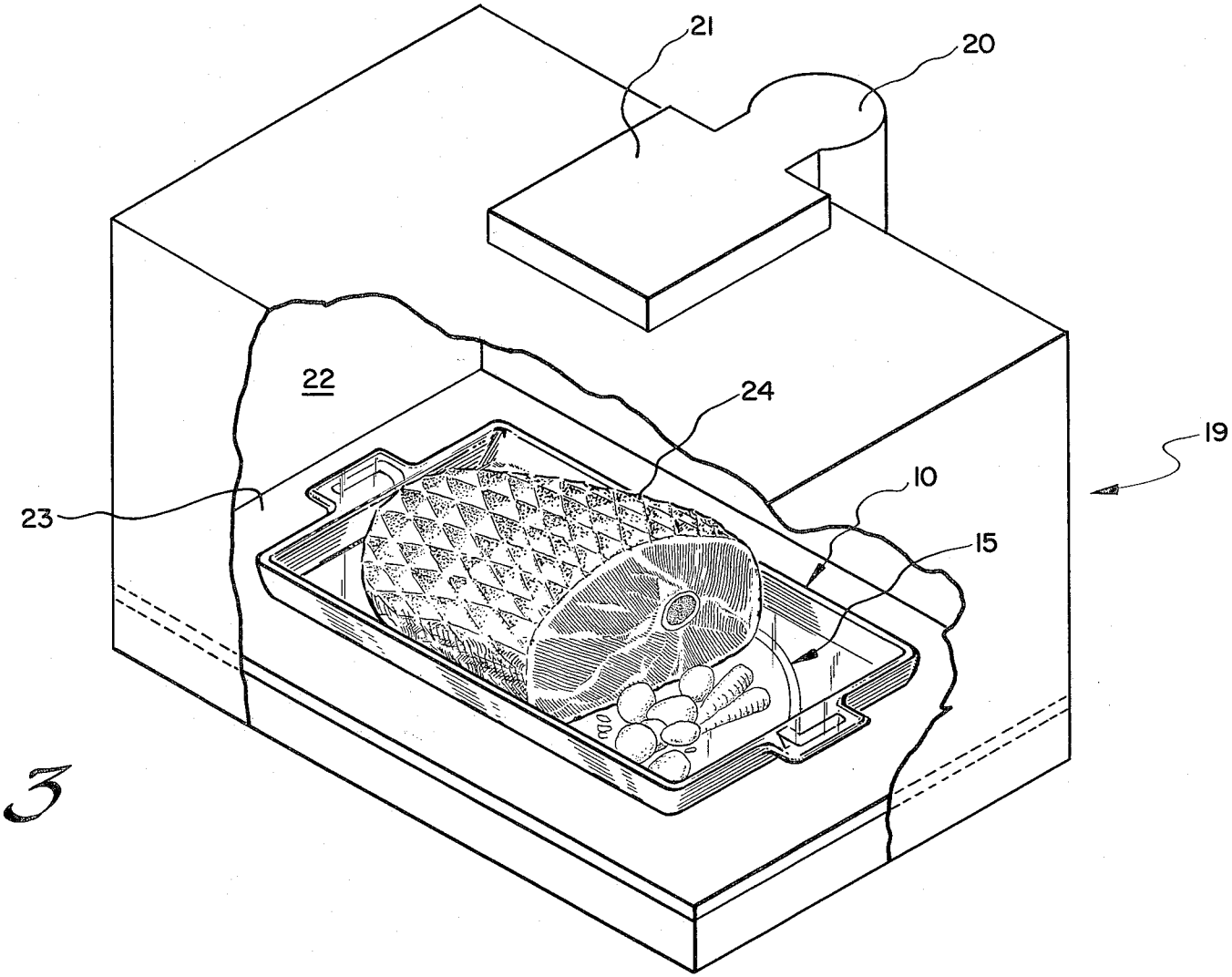
FIG. 3 is a schematic perspective view of a microwave oven and even heating cookware.

Referring to FIG. 3, a conventional microwave oven 19 with top feed of the microwave energy to the oven cavity is assumed. A magnetron source 20, a feed box 21, the oven cavity 22, and a shelf 23 are shown schematically. Wave energy is incident on the top and sides of roast 24 and the meat cooks from the outside toward the inside, and metal layer conductor pattern 15 extracts energy from the electromagnetic fields within the oven cavity and feeds it to the central part of even heating utensil 10 so as to cook the roast from underneath as well as from the sides and top. A uniformly cooked product is obtained without rotating or inverting the food itself.

Metallic pattern 15 may be formed in a variety of ways. In one case, this may consist of a metal overlay on the lower or outer surface of the glass, plastic, or ceramic utensil body. In another case, a thin metal sheet or foil is sandwiched between layers of dielectric material. Embedding the patterned metal within the dielectric utensil is preferred in that mechanical wear of the conductor is avoided and potential sparking at the conductor due to casual contact with metal shelves or such is avoided. The metal pattern is aluminum or copper for good conduction and the dielectric utensil material is typically Pyrex ® glass or polysulfone plastic. Meander conductor 18 is narrow relative to the dimensions of the utensil in order to enable a desired heat pattern resolution to be realized. There is a region of high electric field intensity at every half wavelength and thus increasing the total length of the meander conductor and decreasing its pitch, particularly in the central region of the utensil, gives a higher heat density. Other patterns are possible such as a slanting straight conductor which crosses the center of the utensil. Pickup probes 16 and 17 are relatively short and are not resonant structures.

The metal layer conductor pattern in or on the dielectric utensil is shaped to optimize the heat uniformity for that utensil and the general class of foods for which it is suitable. There are different conductor patterns for different general classes of foods, three of these being cakes and breads, meat, and casseroles or other semi-liquid foods. A set of microwave cookware is provided and the user selects the cookware to fit the class of foods being heated. It is desirable to cook more than one item at the same time and this goal is furthered by delivering energy to food in that vessel or dish at a rate that uniform cooking of the food occurs.

Figure 4:
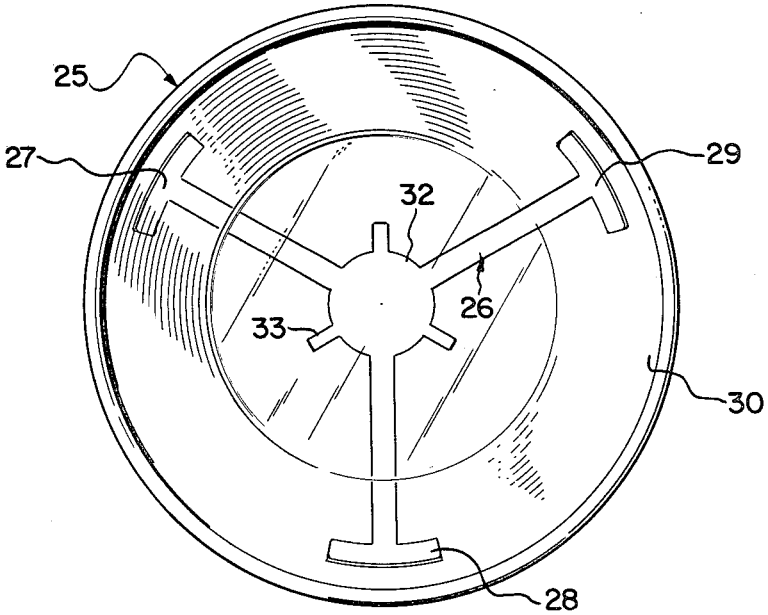
FIGS. 4 and 5 are top and side views, the latter partly in section, of a dielectric cake pan having an interior patterned metal layer.
Figure 5:
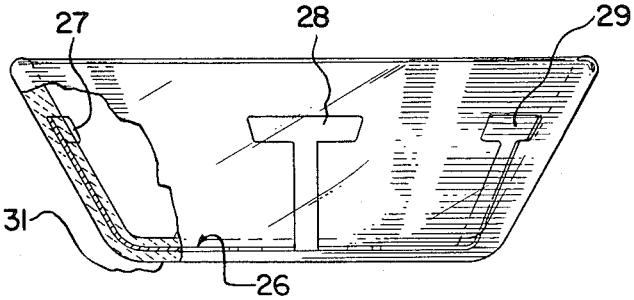

FIGS. 4 and 5 show a dielectric cake pan 25 having an appropriately patterned metal layer 26 to aid in distributing the microwave energy uniformly throughout the material to be cooked. The three T-end metal strip of pickup probes 27-29 are embedded within the side wall 30 of the pan and are connected by metal stripes in the bottom wall 31 to a centrally located conductor pattern which includes a disk 32 and three stubs 33. The entire conductor pattern is symmetrical. The pickup probes couple energy from the fields within the oven cavity to the bottom wall conductor pattern to attain more uniform heating of the cake mix.

While the invention has been particularly shown and described with reference to preferred embodiments thereof, it will be understood by those skilled in the art that various changes in form and details may be made therein without departing from the spirit and scope of the invention.

The invention claimed is:

1. Cookware for use in a microwave oven that has an oven cavity in which there are electromagnetic fields for heating a food load comprising:

a dielectric utensil having a bottom wall;

a patterned metal layer applied to said utensil which is continuous and includes at least one pickup probe and a bottom wall conductor pattern;

said pickup probe serving to couple microwave energy from the oven cavity electromagnetic fields to said bottom wall conductor pattern and realize more uniform heating of the food load in said utensil.

2. Cookware as defined in claim 1 wherein said patterned metal layer is configured to couple the microwave energy to the central region of said bottom wall.

3. Cookware as defined in claim 2 wherein said patterned metal layer is embedded within the dielectric material.

4. Cookware is defined in claim 2 wherein said utensil has laterally projecting hand grips and said pickup probe is on one hand grip.

5. Cookware as defined in claim 2 wherein said utensil has side walls and said pickup probe is on the side wall.

6. Cookware for use in a microwave oven that has an oven cavity in which there are electromagnetic fields for heating a food load comprising:

a dielectric utensil having a bottom wall and laterally projecting hand grips;

a patterned metal layer embedded within said utensil which is continuous and includes metal strip pickup probes in said hand grips and a meander conductor pattern in said bottom wall;

said pickup probes serving to couple microwave energy to said meander conductor pattern from the oven cavity electromagnetic fields and couple the energy to the central region of said utensil to realize more uniform heating of the food load in said utensil.

7. Cookware for use in a microwave oven that has an oven cavity in which there are electromagnetic fields for heating a food load comprising:

a dielectric utensil having a bottom wall and a side wall;

a patterned metal layer embedded within said utensil which is continuous and includes metal strip pickup probes in said side wall and a conductor pattern in the central region of said bottom wall;

said pickup probes serving to couple microwave energy to said bottom wall conductor pattern from the oven cavity electromagnetic field and realize more uniform heating of the food load in said utensil.

* * * * *

UNITED STATES PATENT AND TRADEMARK OFFICE

CERTIFICATE OF CORRECTION

PATENT NO. : 4,320,274

DATED : March 16, 1982

INVENTOR(S) : Rudolph A. Dehn

It is certified that error appears in the above—identified patent and that said Letters Patent is hereby corrected as shown below:

On the title page, [73] Assignee: should read:

[73] Assignee - General Electric Company, Schenectady, New York

On the title page, Attorney, Agent, or Firm should read:

Attorney, Agent or Firm - Donald R. Campbell
James C. Davis, Jr.
Marvin Snyder

Signed and Sealed this

*Twenty-seventh* Day of *July 1982*

[SEAL]

*Attest:*

GERALD J. MOSSINGHOFF

*Attesting Officer*

*Commissioner of Patents and Trademarks*